United States Patent [19]

Imam

[11] 4,384,182

[45] May 17, 1983

[54] HYDRAULIC ACTUATOR FOR AN ELECTRIC CIRCUIT BREAKER

[75] Inventor: Imdad Imam, Colonie, N.Y.

[73] Assignee: General Electric Company, Schenectady, N.Y.

[21] Appl. No.: 154,236

[22] Filed: May 29, 1980

[51] Int. Cl.[3] ..... H01H 33/34; H01H 35/38

[52] U.S. Cl. ..... 200/82 B; 200/148 R; 200/148 F

[58] Field of Search ..... 200/148 F, 82 B, 148 R

[56] References Cited

U.S. PATENT DOCUMENTS

| | | | |
|---|---|---|---|
| 2,740,859 | 4/1956 | Beatty et al. | 200/82 B |
| 2,765,378 | 10/1956 | Perry et al. | 200/82 B |
| 3,008,017 | 11/1961 | Strom et al. | 200/82 B |
| 3,748,418 | 7/1973 | Kawasaki | 200/148 R |
| 3,908,106 | 9/1975 | Hirasawa et al. | 200/82 B |
| 4,118,613 | 10/1978 | Barkan et al. | 200/82 B |
| 4,166,937 | 9/1979 | Imam et al. | 200/82 B |

*Primary Examiner*—Robert S. Macon

*Attorney, Agent, or Firm*—Charles E. Bruzga; James C. Davis, Jr.; Marvin Snyder

[57] ABSTRACT

This actuator comprises a fluid motor having a piston, a breaker-opening space at one side of the piston, and a breaker-closing space at its opposite side. An accumulator freely communicates with the breaker-opening space for supplying pressurized fluid thereto during a circuit breaker opening operation. The breaker-opening space and the breaker-closing space are connected by an impeded flow passage. A pilot valve opens to allow the pressurized liquid in the breaker-closing space to flow to a back chamber of a normally closed main valve to cause the main valve to be opened during a circuit breaker opening operation to release the pressurized liquid from the breaker-closing space. An impeded passage affords communication between the back chamber and a sump located on the opposite side of the main valve from the back chamber. The pilot valve and impeded passage allow rapid opening of the main valve with pressurized liquid from the breaker closing side of the piston.

3 Claims, 3 Drawing Figures

HYDRAULIC ACTUATOR FOR AN ELECTRIC CIRCUIT BREAKER

The Government of the United States of America has rights in this invention pursuant to contract No. EX-76-C-01-2065 awarded by the U.S. Department of Energy.

BACKGROUND OF THE INVENTION

This invention relates to an hydraulic actuator for operating an electric circuit breaker and, more particularly, relates to rapid-response, simple valve control means for controlling opening and closing of the circuit breaker.

In U.S. Pat. No. 4,166,937 issued Sept. 4, 1979 to Imam, et al., assigned to the instant assignee, and incorporated herein by reference thereto, an operating system for very fast circuit breaker operation control is described. An electromagnetic repulsion coil solenoid is used to operate a control valve attached to the breaker closing space of a fluid motor. In order to achieve the very short response time, a large repulsion coil capable of moving the control valve in a very short time is required.

SUMMARY OF THE INVENTION

An object of my instant invention is to affect fast circuit breaker operation and control using a pair of two-way valves requiring less power to actuate than the prior art actuator. A further object is to provide a high speed hydraulic actuator especially suited for 1–2 cycle high voltage breakers. A more particular object of the instant invention is to employ two two-way valves and a conventional solenoid in combination with a piping connection arrangement to control the opening of a high voltage circuit breaker.

In carrying out the instant invention a fluid motor comprising a piston, a breaker-opening space on one side of the piston, and a breaker-closing space on the opposite side of the piston is employed to operate a high voltage circuit breaker. An accumulator freely communicates with the breaker-opening space for supplying pressurized liquid thereto during the circuit breaker opening operation. A normally closed pilot valve is disposed in unimpeded flow communication with said breaker-closing space. A solenoid is operably connected to said pilot valve to open said pilot valve upon receiving a circuit breaker opening signal. A normally closed valve located in unimpeded flow communication with the breaker-closing space side of the piston is operable to release liquid from the breaker-closing space so that pressurized liquid in the breaker-opening space can drive the piston in an opening direction. The valve comprises a movable valve member that is movable from a valve-closed position to a valve-open position to open the valve and is returnable to said valve-closed position. A back chamber of the control valve is in flow communication with said breaker-closing space by a large volume flow passage in which the normally closed pilot valve is operably disposed. Said back chamber of said control valve is in flow communication with a pressure sump in flow communication with one side of the control valve. Means is provided for returning the valve member to said valve-closed position following the circuit breaker opening operation. An impeded fluid flow passage affords flow communication between the accumulator and the breaker-closing space for allowing pressurized liquid to flow from the accumulator to the breaker-closing space and develop a pressure within said breaker-closing space substantially equal to accumulator pressure when said valve member is returned to said valve-closed position following a circuit breaker opening operation. The passage is so impeded that flow therethrough from said accumulator into said breaker-closing space is sufficiently low during initial opening motion of said piston through a substantial portion of its opening stroke as to avoid interference with said piston opening motion during said initial opening motion of said piston.

BRIEF DESCRIPTION OF THE DRAWINGS

The features of the invention believed to be novel and unobvious over the prior art are set forth with particularity in the appended claims. The invention itself, however, as to organization, method of operation and advantages thereof, may best be understood by reference to the following description taken in conjunction with the accompanying drawings in which:

DESCRIPTION OF THE PREFERRED EMBODIMENTS

Figure 1:
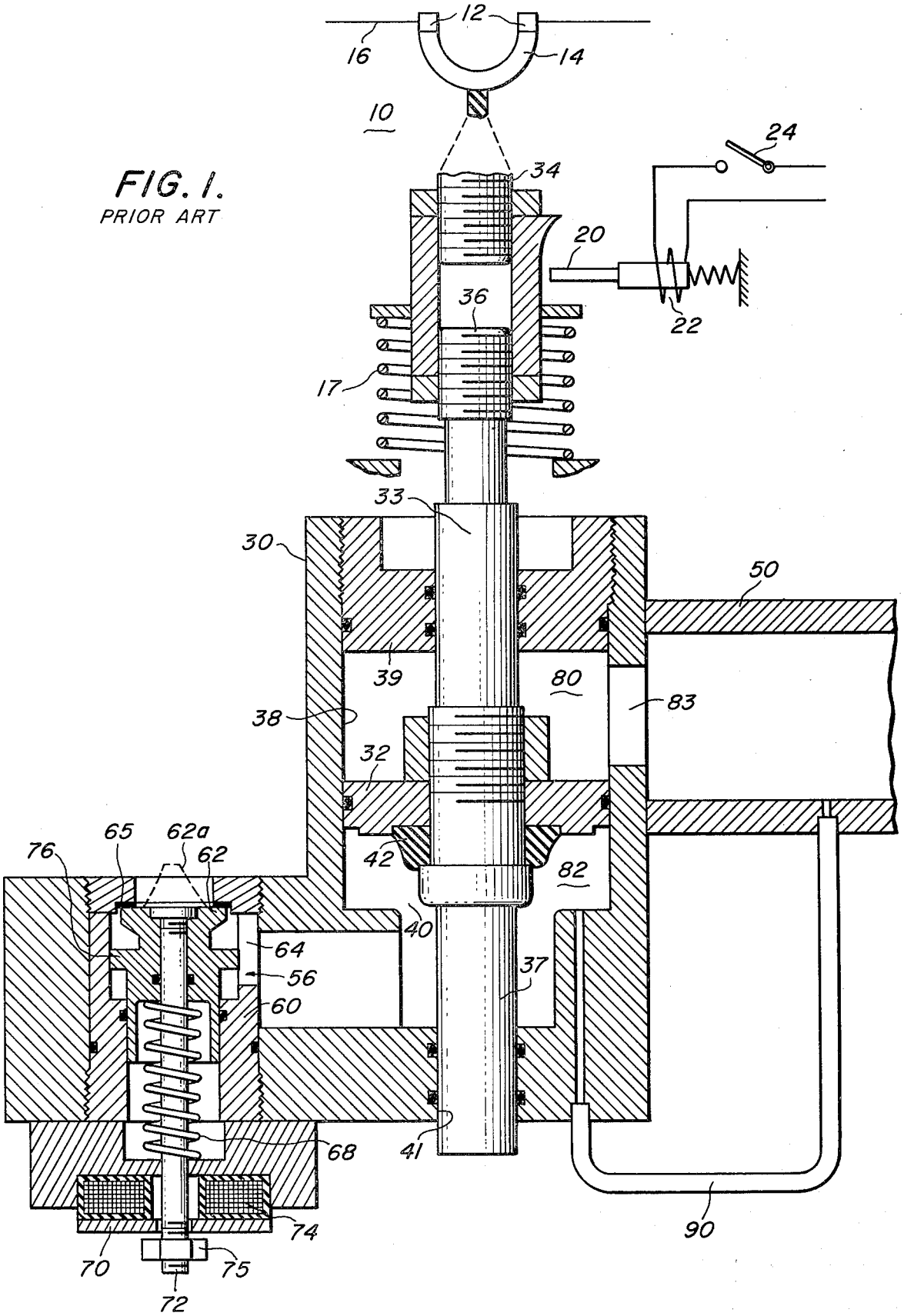
FIG. 1. PRIOR ART
FIG. 1 is a partially schematic sectional view of a circuit breaker including a prior art hydraulic operating system

Referring now to FIG. 1, there is shown a view of the circuit breaker described in the above-cited U.S. Pat. No. 4,166,937. Circuit breaker 10 comprises a set of separable contacts 12 and 14 for controlling a power circuit 16. The contacts 12 are stationary contacts, and the contact 14 is a movable contact that is adapted to be actuated by means of a fluid motor 30. Fluid motor 30, comprises a piston 32 coupled to movable contact 14 through an operating rod 33 that has an insulating portion 34 and a metal portion 36 interconnecting the insulating portion 34 and piston 32.

Fluid motor 30 further comprises a cylinder 38 within which piston 32 is vertically movable. The upper end of cylinder 38 is closed by an upper end wall 39 through which piston rod portion 36 slidably extends in sealed relationship. The lower end wall of cylinder 38 contains a central opening 40 through which a lower portion 37 of operating rod 33 extends. A continuation of lower portion 37 extends downwardly through a sealed opening 41 in the cylinder wall to atmosphere. Movable contact 14 is biased into its closed position of FIG. 1 by a differential force acting in an upward direction on piston 32. In this regard, since the portion of piston rod 36 extending through upper end wall 39 is larger in cross-section than the lower piston rod portion 37 extending through opening 41, there is a net area of the piston structure exposed to upwardlyacting pressure. When the pressure on both sides of piston 32 is the same, which is the case when the circuit breaker is in its closed at-rest position, there is a net force biasing the piston in an upward closing direction.

The cylinder space 80 at the upper side of piston 32 constitutes a breaker-opening space in which pressurized liquid can act on piston 32 to drive it downwardly from its closed position and, thus, open the circuit breaker. The cylinder space 82 at the opposite, or lower, side of piston 32 constitutes a breaker-closing space in which pressurized liquid acts on piston 32 in an upward, or circuit-breaker closing direction.

Pressurized fluid for driving piston 32 in a downward opening direction is derived from an accumulator 50 that freely communicates with breaker-opening space 80 through a minimum-length, large-diameter passage including a large port 83 in cylinder 38. Accumulator 50 is of a conventional design and has a capacity that allows it to supply pressurized liquid for several complete circuit-breaker opening and closing operation without requiring recharging. Charging of accumulator 50 is effected by reliance upon a pump (not shown) connected to the accumulator and controlled in a conventional manner.

The breaker-closing space 82 beneath piston 32 communicates with accumulator 50 through a long impeded passageway 90. When the circuit breaker is in its closed position, breaker-closing space 82 is filled with pressurized liquid at accumulator pressure. Since the piston has a net area on which pressure acts in an upward direction, with accumulator pressure acting on both sides of piston 32, there is a net force within fluid motor 30 biasing the circuit breaker into its closed position. Supplementing this upward closing bias is an additional closing force derived from a spring 17. In case pressure is inadvertently lost in the accumulator and, hence, in the fluid motor 30, this spring 17 will hold the circuit breaker contacts in the closed position.

Located on the lower, or breaker-closing-space, side of the piston 32 is a normally-closed two-way control valve 56 that is openable to release pressurized liquid from the breaker-closing space 82, so that pressurized liquid in the breaker-opening space 80 above piston 32 can drive the piston in a circuit-breaker opening direction. The control valve 56 comprises a cylindrical valve body 60 and a movable valve member 62 of the poppet type slidably mounted in the cylindrical valve body. The cylindrical valve body has a large port 64 extending therethrough and an annular valve seat 65 at its upper end against which the movable poppet valve member 62 seats when in its closed position. A compression spring 68 biases the movable valve member 62 upwardly into its closed position, supplementing a slight hydraulic closing bias on the valve member 62.

For actuating the movable valve member 62, a repulsion-type solenoid of a generally conventional design is used that comprises a stationary coil 74 and an armature 70 coupled to the movable valve member 62 through an operating rod 72. Armature 70 is a disc of highly conductive metal such as copper. The armature is normally held in close proximity to the stationary coil 74 by spring 68 and a nut 75 on rod 72. When the coil 74 is energized by a suitable pulse of current, it develops a magnetic field which induces eddy currents in the armature 70. These eddy currents generate a magnetic field which reacts with the magnetic field created by the coil to produce a rapidly rising repulsion force between the armature and the coil that quickly drives the armature downwardly against the above-described opposing bias. This downward movement of armature 74 acts through nut 75 and operating rod 72 to drive movable valve member 62 downwardly.

Figure 2:
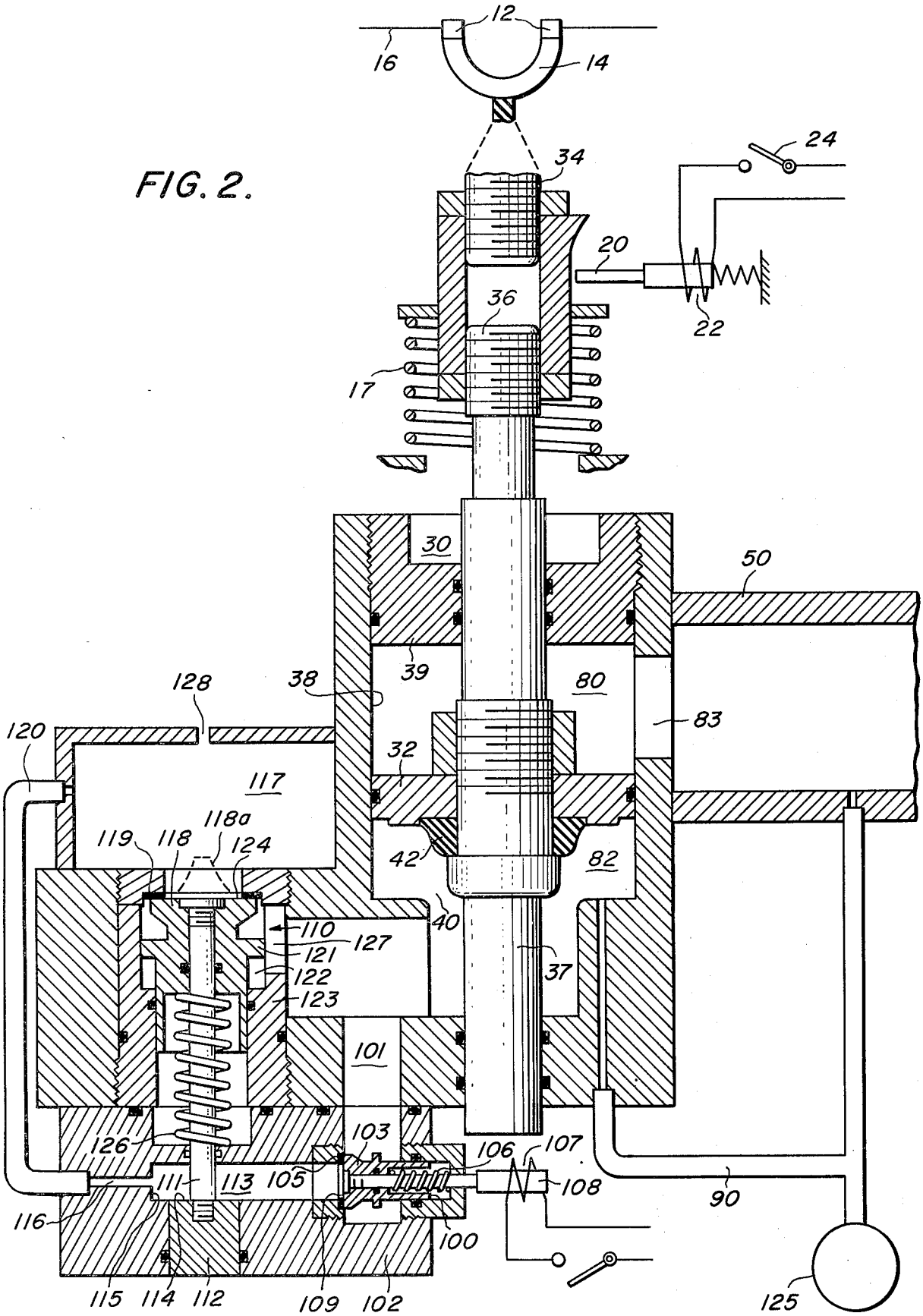
FIG. 2 is a partially schematic sectional view of a circuit breaker including an hydraulic operating system embodying the instant invention, and the hydraulic operating system is shown in its normal at rest condition in which it is prepared to initiate an opening operation of the circuit breaker.
Figure 3:
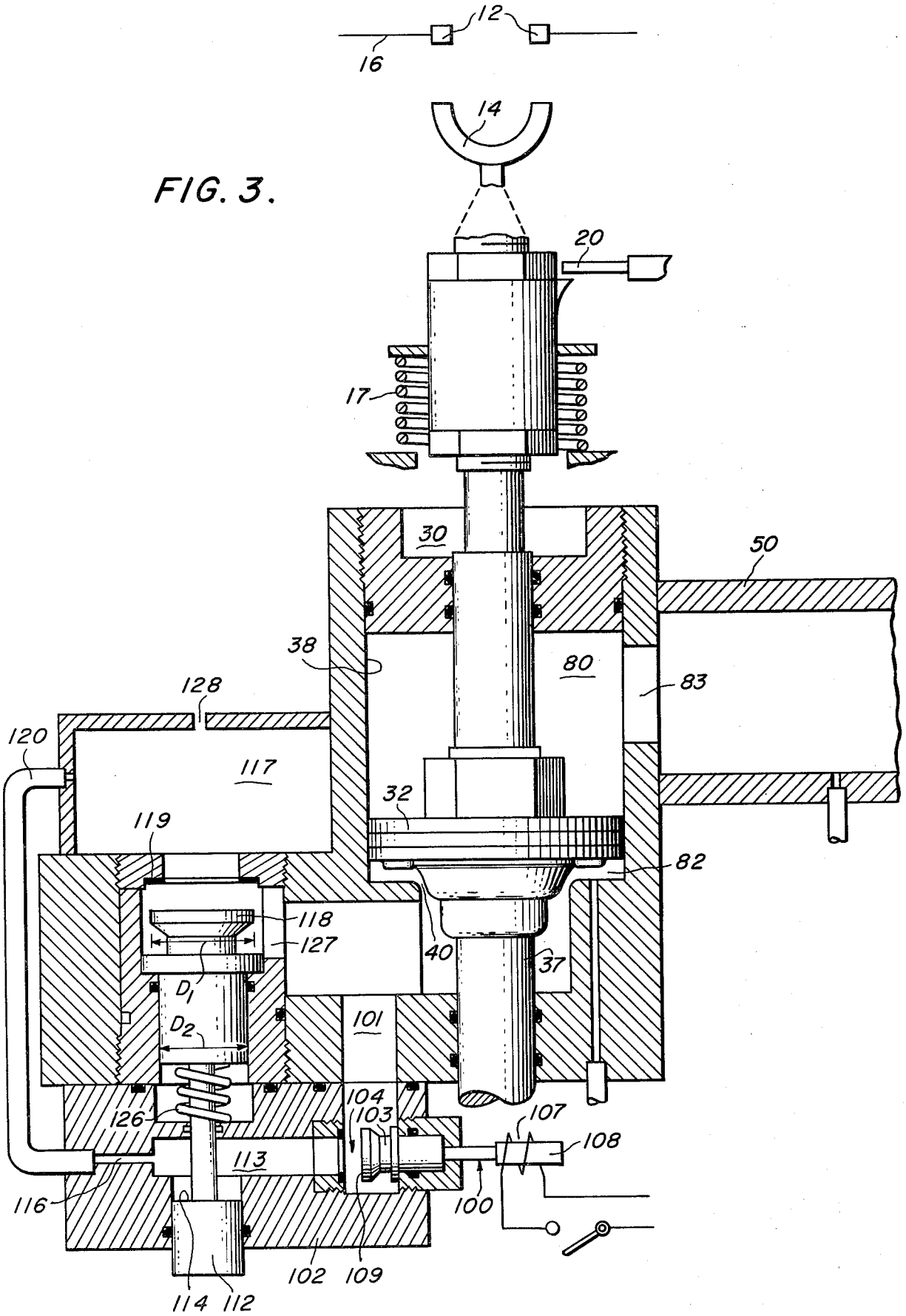
FIG. 3 is a partially schematic sectional view of the circuit breaker of FIG. 2 with the hydraulic operating system shown at an instant near the end of a circuit breaker opening operation but prior to resetting of the control valve system.

FIGS. 2 and 3 illustrate the actuating mechanism of my instant invention. A second two-way pilot valve 100 is connected to the main control valve 110 to provide a flow of pressurized liquid to open the control valve. The pilot valve 100 is in unimpeded flow communication with the breaker closing space 82 of piston 32 via a large flow path 101 normally closed by the pilot valve. The pilot valve 100 comprises a cylindrical valve body 102 and a movable valve member 103 of the poppet type slidably mounted in the cylindrical valve body. This cylindrical valve body 102 has a large port 104 extending therethrough and an annular valve seat 105 at one end against which the movable poppet valve member 103 seats when it is in the closed position. A compression spring 106 biases movable valve member 103 toward its closed position as shown in FIG. 2. At one end of the rod 111 of the control valve 110 a shoulder member 112 is attached. A back chamber 113 constitutes an unimpeded flow path controlled by pilot valve 100 connecting the surface 114 of shoulder member 112 with the flow passage 101 which connects the breaker-closing space 82 of fluid motor 30 with back chamber 113. Pilot valve 100 closes flow passage 101 when in the position shown in FIG. 2. At one end 115 of the control valve back chamber 113 is an impeded flow passage 116 which connects the back chamber to a sump 117 which is in flow communication with main control valve 110. A conventional solenoid 107 is connected to the pilot valve drive rod 108 to open valve 100 upon a command from a control device (not shown).

My instant invention operates as follows. When the main circuit 16 is in the closed, current-carrying condition, both the pilot and main valves are closed and the piston 32 is in the position shown in FIG. 2. The accumulator 50 and the cylinder 38 are pressurized. Upon command of a control device (not shown) to open the breaker, the solenoid 107 operating pilot valve 100 is energized, moving pilot valve member 103 to the open position as shown in FIG. 3. High pressure liquid flows from breaker-closing space 82 to the back chamber 113 of the control valve 110 through the pilot valve 100. Pressure in back chamber 113 builds up rapidly, and as the force on the shoulder 112 exceeds the seating force of control valve 110, the control valve opens.

Downward opening motion of valve member 118 from its closed position of FIG. 2 allows high pressure liquid in breaker-closing space 82 to immediately flow through large port 127 past valve seat 119 to low pressure sump 117 maintained at essentially atmospheric pressure by vent 128 thus collapsing the hydraulic pressure in space 82. The pressurized fluid flowing past the valve seat 119 makes a 90° turn in this region, and thus has a momentum effect on the movable valve member 118 that acts in a downward direction on its upper face thus rapidly providing a high downward force on the valve member 118, which in combination with the pressure on the shoulder 112 forces the valve member downward rapidly. This momentum effect on the movable valve member can be accentuated and made more efficient by providing a tapered projection on the upper end of the movable valve member, shown in dotted lines at 118*a* in FIG. 2. This projection guides the flow more smoothly through its 90 degree turn in this region. Additionally liquid from the impeded flow passage 116 enters sump 117 via tube 120 above valve member 118 and also acts downwardly to assist opening movement of the valve member. As valve member 118 nears its open position as shown in FIG. 3 at the end of its downward opening stroke, a piston 121 thereon enters the closed end 122 of the valve body 123 providing a dash-potting effect that smoothly terminates such opening movement of the valve member.

A few milliseconds after the opening command, the pilot valve solenoid 107 de-energizes. However, pilot valve 100 remains opened under the influence of the liquid pressure of liquid flowing from breaker closing space 82 through passage 101 to back chamber 113 of control valve 110 acting on surface 109. After the poppet control valve 110 has opened to some distance, the flow reaction force and the liquid pressure downstream of the control valve both begin to act upon the face 124 of the control valve, causing control valve 110 to open more rapidly, because the poppet is being pulled at one end to which shoulder 112 is attached, and pushed at the other end by the reaction force and the liquid pressure, both forces acting in the same direction simultaneously. After a few milliseconds, the pressure in back chamber 113 of control valve 110 would disappear because of the impeded pipe connection 120 to the sump 117. However, by that time the controlled valve opening would be substantially completed.

The circuit breaker is then held open by a suitable hold-open latch 20 that becomes effective at the end of the circuit-breaker opening operation. Subsequent closing is effected by releasing the hold-open latch 20 to permit the pressurized liquid in space 82 beneath piston 32 to return movable contact 14 to its closed position. Although there is pressurized liquid above the piston at this time, the pressure beneath the piston is effective to produce closing because a slight hydraulic closing bias on valve member 118 results from dimension $D_1$ of the movable valve member 118 being slightly larger than $D_2$ as seen in FIG. 3. This release of latch 20 to initiate closing is effected by means of a solenoid 22 which is operated by completing an energizing circuit through its coil by closing a closing-control switch 24. As control valve 110 opens, liquid pressure below piston 32 drops, and the piston moves downward. At the end of the opening operation, pressure below the piston drops to atmospheric pressure and does not rise for several milliseconds. This is because, the space below piston 32 becomes nearly empty at the end of the opening operation because of the liquid momentum effects. All the liquid below piston 32 in closing space 82 goes to sump 117. The pressure in space 82 rises only after this space is filled with liquid again. This takes a few milliseconds, due to the inertia and friction effect of the liquid in impeded passage 90. The filling of the space is further delayed, because the bottom portion of piston 32 substantially covers the outlet of pipe 90 when the breaker is in open position. While some liquid comes from this outlet into space 82 to fill it, pressure does not rise substantially until valves 100 and 110 are closed.

During this period and because of these unique features both the control valve 110 and the pilot valve 100 reset under the influence of their respective resetting springs without any interference from liquid pressure in the breaker-closing space.

The breaker is held in the open position by latch mechanism 20, and after control valve 110 and pilot valve 100 are closed, pressure begins to build up within breaker closing space 82, as a result of pressurized liquid entering the space 82 from the accumulator through restricted passage 90. This pressue buildup in space 82 is restrained from initiating a closing operation, because the circuit breaker is held open by latch 20. Subsequent closing of the circuit breaker is effected by releasing the hold-open latch 20 effected by means of a solenoid 22 which is operated by completing an energizing circuit through its coil by closing a closing control switch 24. This permits the pressurized liquid in space 82 beneath piston 32 to return movable contact 14 to its closed position. Although there is pressurized liquid above piston 32 at this time, the pressure beneath the piston is effective to produce closing, because the net area of the piston exposed to the upwardly acting pressure is greater than the net area exposed to downwardly acting pressure, since the lower portion 37 is of a lesser diameter than the upper portion 36 of the rod 33. A pump 125 as shown may be connected to the passage 90 to maintain liquid pressure in the accumulator 50. The restricted passage 90 performs the functions described in the above-cited U.S. Pat. No. 4,166,937.

In addition to providing an impeded flow path connecting the back chamber 113 with the sump 117, the impeded passage 116 allows accommodation of a slight leak from pilot valve 100 of hydraulic liquid which would flow through the restricted passage 116 to the sump 117, thereby not allowing the control valve 110 to open without an appropriate command.

To produce another opening operation immediately following a closing or reclosing operation, it is necessary merely to again open control valve 110, since the breaker closing space 82 would be pressurized through passage 90 from the accumulator. An opening command to the solenoid 107 operating pilot valve 100 would again cause back space 113 of the main control valve 110 to be pressurized, so that main control valve 110 would be opened. This collapses the pressure in breaker closing space 82, allowing accumulator pressure above the piston 32 to produce another opening operation, all in the same manner as described for the first opening operation.

The opening system described herein has the following important features. The system is capable of achieving rapid circuit breaker opening employing a light duty conventional solenoid for opening the pilot valve. The pilot valve and solenoid are relatively inexpensive, and therefore redundant tripping can be achieved relatively more economically than is possible with the repulsion coil device of the prior art. Furthermore, the shaft of the main control valve is not subjected to the shock loading provided by the prior art repulsion coil solenoid upon an opening command. Since the pilot valve 100 is located in close proximity to the high pressure source and since the breaker closing space 82 of the liquid motor 30 and the pilot valve 100 are located very close to control valve 100, rapid response may be achieved by the present system. Resetting of the pilot valve and main valve is assured, because following an opening operation, liquid pressure below piston 32 in the cylinder goes to about one atmosphere (the pressure of the sump 117) and remains there for several milliseconds. Also, slight leaks in the pilot valve 100 or the main control valve 110 will not cause false tripping of the mechanism, because the pipe connection 90 maintains the pressure at each side of piston 32 at the same level, and pipe connection 120 maintains pressure in back chamber 113 at about atmospheric pressure, until an opening command is received. Another feature of my present system is that resetting of the system and reclosing of the circuit breaker can be achieved without any additional valves or controls for the valves beyond those already described.

An important feature of the instant invention is its short resetting time. One factor contributing to this is that the liquid pressure beneath piston 32 drops to substantially zero the instant piston 32 stops moving at the end of its opening stroke. Indeed, negative pressures are created as a consequence of momentum of the fluid flowing through control valve 110. This low pressure allows the control valve 110 to quickly reset under the influence of its reset spring 126. As soon as control valve 110 resets, breaker closing can begin because the accumulator 50 is already charged. In this latter regard, note that it is not necessary to rely upon an accumulator of limited capacity, since even after an opening operation, accumulator 50 in the present system still has enough charge left to produce a multiple series of closed-open operations should this be required.

In the drawings, the interrupting portion of the circuit breaker (i.e., contact structure 12, 14) has been shown schematically only. In a preferred form of the invention this interrupting structure is constituted by one or more vacuum-type circuit interrupters, such as disclosed, for example in U.S. Pat. No. 3,462,572 Sofianek or U.S. Pat. No. 3,246,979 Lafferty et al. It is to be understood, however, that our invention in its broader aspects is not limited to use in operating systems for vacuum interrupters. It may also be used with other types of interrupters, such as oil interrupters or gas blast interrupters, including those of the puffer type, such as shown for example in U.S. Pat. No. 3,739,125 Noeske or U.S. Pat. No. 3,602,670 Teijeiro.

The above described invention can be used for one and two cycle high voltage circuit breakers such as vacuum interrupters or puffer breakers using for example $SF_6$ as the arc extinguishing medium. The above described invention allows circuit interruption employing only 2 two-way valves and appropriate pipe connections in combination with a light duty conventional solenoid employing limited tripping force, subjecting the system to minimal shock and thereby increasing system reliability.

The above described embodiment of this invention is intended to be exemplary only and not limiting, and it will be appreciated from the foregoing by those skilled in the art that many substitutions, alterations and changes may be made to the disclosed structure without departing from the fundamental concept of the invention.

I claim:

1. In an hydraulically-actuated operating system for an electric circuit breaker:

a fluid motor comprising a cylinder and a movable piston adapted to move in an opening direction within said cylinder to open said circuit breaker and in a reverse direction within said cylinder to close said circuit breaker, the cylinder space at one side of said piston constituting a breaker-opening space in which pressurized liquid can act on said piston to open said circuit breaker and the cylinder space at the opposite side of said piston constituting a breaker-closing space in which pressurized liquid can act on said piston to close said circuit breaker;

an accumulator freely communicating with said breaker-opening space for supplying pressurized liquid thereto during a circuit-breaker opening operation;

a normally-closed control valve located on the breaker-closing space side of said piston and openable to release liquid from said breaker-closing space so that pressurized liquid in said breaker-opening space can drive said piston in an opening direction, said control valve comprising a movable valve member that is movable from a valve-closed position to a valve-open position to open said control valve and is returnable to said valve-closed position to close said valve;

means for moving said valve member to said valve-open position comprising a pilot valve means disposed hydraulically between said breaker-closing space and a back chamber of said control valve to control flow of liquid to said back chamber of said control valve to apply liquid pressure to a shoulder member operatively attached to said movable valve member, and an impeded passage affording flow communication from said back chamber to a sump in flow communication with one side of said valve member;

means operable in response to the pressure in the breaker-closing space dropping to a predetermined level for returning said valve member to said valve-closed position following a circuit-breaker opening operation; and an impeded passage affording communication between said accumulator and said breaker-closing space for allowing pressurized liquid to flow from said accumulator to said breaker-closing space and develop a pressure within said breaker-closing space substantially equal to accumulator pressure when said valve member is returned to said valve-closed position following a circuit-breaker opening operation, said passage being so impeded that the flow therethrough from said accumulator into said breaker-closing space during opening motion of said piston is sufficiently low during initial opening motion of said piston through a substantial portion of its opening stroke as to avoid interference with said piston motion during said initial opening motion of said piston.

2. The operating system of claim 1 in which:

said piston occupies a circuit-breaker closed position when the circuit breaker is closed and a circuit-breaker open position when the circuit breaker is open, and said operating system further comprises:

releasable latching means for holding said piston in said circuit-breaker open position after a circuit-breaker opening operation; and means for releasing said latching means to allow the pressure within said breaker-closing space to drive said piston from said circuit-breaker open position to said circuit-breaker closed position.

3. The operating system of claim 2 wherein said pilot valve means comprises:

a movable valve member disposed within a valve housing and being movable between a valve-closed position and a valve-open position;

solenoid means for moving said valve member of said pilot valve from said valve-closed position to said valve-open position; and means operable in response to the pressure in the back chamber of said control valve dropping to a predetermined level for returning said valve member to said valve-closed position following a circuit-breaker opening operation.

* * * * *